US005605403A

United States Patent [19]

Vegeais et al.

[11] Patent Number: 5,605,403

[45] Date of Patent: Feb. 25, 1997

[54] INKING RIBBON LOADING SHOE FOR A PRINTER WITH THERMAL TRANSFER PRINTING

[75] Inventors: Patrick Vegeais, Paris; Eric Cavarero, Conflans Sainte Honorine, both of France

[73] Assignee: Societe D'Applications Generales D'Electricite et de Mechanique Sagem, France

[21] Appl. No.: 356,672

[22] Filed: Dec. 15, 1994

[30] Foreign Application Priority Data

Dec. 15, 1993 [FR] France ..... 93 15094

[51] Int. Cl.[6] ..... B41J 35/28

[52] U.S. Cl. ..... 400/207; 400/250; 206/393

[58] Field of Search ..... 400/250, 242, 400/207, 208, 208.1, 692, 693.1, 246; 206/393, 394

[56] References Cited

U.S. PATENT DOCUMENTS

| | | | |
|---|---|---|---|
| 4,367,963 | 1/1983 | Daughters | 400/207 |
| 5,415,486 | 5/1995 | Wouters et al. | 400/692 |
| 5,433,540 | 7/1995 | Alday | 400/250 |
| 5,480,242 | 1/1996 | Gunderson | 400/692 |

FOREIGN PATENT DOCUMENTS

| | | | |
|---|---|---|---|
| 0423647 | 4/1991 | European Pat. Off. . | |
| 0466186 | 1/1992 | European Pat. Off. . | |
| 0557184 | 8/1993 | European Pat. Off. . | |
| 0593821 | 4/1994 | European Pat. Off. . | |
| 213181 | 9/1986 | Japan | 400/242 |

OTHER PUBLICATIONS

Patent Abstracts of Japan, vol. 11, No. 50 (M-562) (2497), Feb. 17, 1987, & JP-A-61 213181, Sep. 22, 1986, Abstract.

Patent Abstracts of Japan, vol. 11, No. 71 (M-567) (2518), Mar. 4, 1987, & JP-A-61 227079, Oct. 9, 1986, Abstract.

*Primary Examiner*—Edgar S. Burr
*Assistant Examiner*—Daniel J. Colilla
*Attorney, Agent, or Firm*—Graham & James LLP

[57] ABSTRACT

A cartridge (1) for loading a thermal transfer printing ribbon (10) into a thermal transfer printer is disclosed. The cartridge (1) is adapted to receive and detachably hold a ribbon pay-out roll (5) and a ribbon take-up roll (6) in their operating positions relative to each other. Each cartridge is provided with means (8, 9) for fixing the cartridge (1) to the printer while leaving the fixing means (8, 9) exposed.

4 Claims, 1 Drawing Sheet

INKING RIBBON LOADING SHOE FOR A PRINTER WITH THERMAL TRANSFER PRINTING

BACKGROUND OF THE INVENTION

1. Field of the Invention

The field of the invention is that of printers, peripheral printers for central control units, such as printers incorporated into printing apparatuses, such as fax machines.

2. Discussion of Related Art

Two types of printer are mainly known: printers with laser printing and printers with thermal printing. The field of the invention is that of the latter printers. Printers with thermal printing, provided with a head of resistive heating elements, use, as the printing medium, either thermal paper, on a roll, or ordinary paper in the form of sheets.

The field of the invention is, even more particularly, that of printers with thermal printing using sheets of ordinary paper, that is to say printers with heat transfer printing. Printing takes place, under the action of the printing head, by transfer of an ink which melts on heating and is deposited beforehand on a support film, the whole forming a printing ribbon. The invention relates to these inking printing ribbons which have, consequently, a width at least equal to that of the sheets intended to be printed.

The precise positioning of these very thin ribbons in a printer involves manipulation weighed down with precautions if it is desired not to waste length, while still correctly tensioning the ribbons.

It has already been proposed to use, in a printer, an intermediate and removable cradle arranged to receive a ribbon pay-out roll and a ribbon take-up roll, by the clipping-in of their spindles, the positioning or loading of the rolls on the cradle being performed quite easily after having removed the cradle from the printer and before repositioning it therein. However, such a solution, with a removable cradle, can only be suitable for printers of relatively large size.

SUMMARY OF THE INVENTION

The present invention aims to provide a completely different solution.

For this purpose, the present invention relates to a shoe for loading, into a printer with thermal transfer printing, a thermal transfer printing ribbon, the shoe being arranged to receive and hold, in a detachable manner and in their relative use position, a ribbon pay-out roll and a ribbon take-up roll, each provided with means for fixing to the printer, the shoe leaving said fixing means exposed.

It therefore suffices, for loading the rolls into the printer, to take the shoe, present it so as to insert the rolls into the printer and to engage their fixing means into the corresponding fixing means of the printer in order to fix the rolls precisely therein, before disengaging the shoe, without the rolls, by virtue of the detachable nature of the means for holding the rolls in the shoe.

Loading of the rolls is thus performed simply, without the user having to touch the inking ribbon and without it being wasted whatsoever.

Of course, the loading of the rolls into the printer must be performed after having disengaged the "compressor", or the writing or pressing roller, from the printing head with which it has to interact mechanically during printing.

The shoe of the invention, with its ribbon rolls, ready for use, may be arranged in a box or put into a capsule or bag.

The shoe may also be disposable.

At least one of the rolls of ribbon is preferably received in a housing in the shoe, provided with at least one rubbing edge arranged to interact with the roll when it is detached from the shoe and thus to tension the ribbon.

In this case, the housing with a rubbing edge advantageously includes a rubbing tongue with an inner wall pushed back, beyond the contact area of the housing and the roll in the detachment plane of the roll, on the other side of this plane.

Thus, in order to detach the rolls from the shoe, it is necessary to push the rubbing, or gripping tongue back, this enabling the ribbon to be tensioned between the two rolls.

BRIEF DESCRIPTION OF THE DRAWINGS

The invention will be better understood with the aid of the following description of several embodiments of the loading shoe of the invention, with reference to the appended drawing in which.

DETAILED DESCRIPTION OF THE PREFERRED EMBODIMENTS

Figure 1:
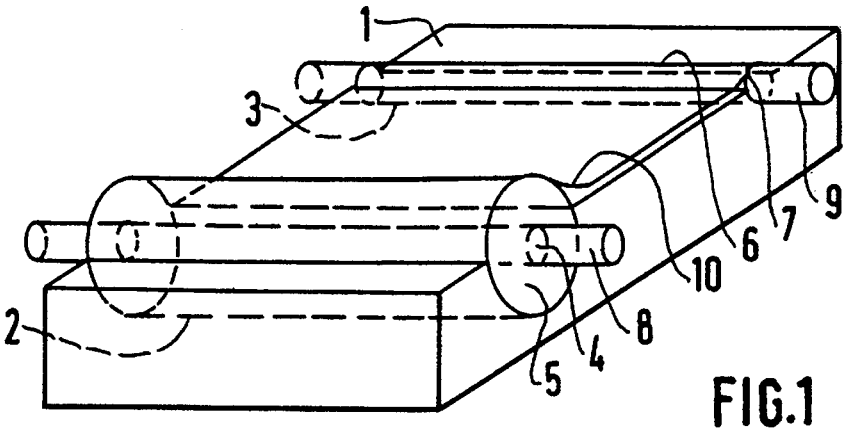
FIG. 1 is a perspective view of a first embodiment of the loading shoe of the invention.

The loading shoe 1, made here of polystyrene, has a parallelepipedal overall shape and includes, made from one of the large faces, two housings 2 and 3, here of substantially semicircular cross section, extending parallel to each other.

The housing 2 receives, in a detachable, and in this case adjusted manner, a pay-out roll 5 for a thermal transfer printing ribbon 10 wound around a spindle 4 and the housing 3 likewise contains a take-up spindle 6 to which is fastened the free end 7 of the tape 10 and which may all the same be termed the take-up roll. Of course, on the shoe 1, the pay-out roll 5 is full and the take-up roll 6 is virtually empty.

The opening widths of the housings 2 and 3 are slightly less, respectively, than the diameters of the roll 5 and the roll 6, this ensuring, due to the elasticity of the material of the shoe 1, the reception and holding of these rolls, while still enabling them to be detached from the shoe 1, in a radial direction, by applying sufficient extraction forces. The distance between centers of the spindles 4 and 6 is equal to that made between fixing bearings of a printer intended to consume the ribbon 10.

The housings 2 and 3 are open at the end and have, in this example, an axial length substantially equal to that of the ribbon 10. The spindles 4 and 6 extend axially beyond the shoe 1 by fixing ends 8, 9 which are exposed and described in more detail with reference to FIG. 3.

Figure 2:
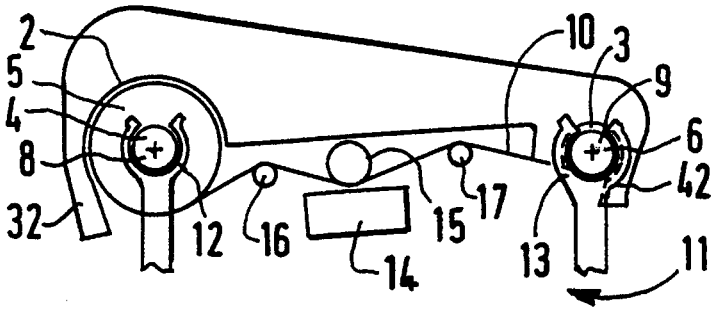
FIG. 2 is a side view of a second embodiment of the shoe of the invention, in the loading position.

In FIG. 2, which illustrates the use of the shoe, the shoe 1 is applied against a ribbon loading area of a printer 11. The printer 11 includes two pairs of bearings 12 and 13, in this case shaped like a lyre, each receiving one of the fixing ends 8 and 9. Between the bearings 12 and 13 are a writing head 14 and a compressor 15, or writing or pressing roller, and two tensioning rollers 16 and 17, respectively upstream and downstream of the head 14.

In FIG. 2, the writing roller 15 is depicted in the use position. It may be moved away from this functional position in order to enable the shoe 1 to be applied against the printer 11 and to enable the rolls 5, 6 to be positioned or loaded, bringing the tape 10 into contact with the writing head 14. The roller 15, after removing the shoe 1, is subsequently pushed back in order to press the tape 10 against the head 14.

Figure 3:
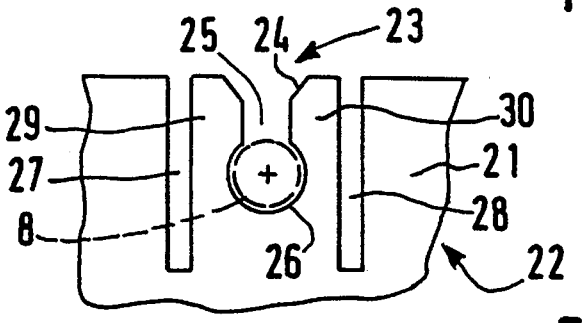
FIG. 3 is a view of a bearing for fixing, in a printer, one of the ribbon rolls of the shoe of the invention

Depicted in FIG. 3 is a bearing 22 for receiving and holding, in this case by clipping-in, a spindle fixing end 8, 9 of the spindles 4, 6. The bearing 22 is formed by a recess 23 made in one edge of a wall 21 of the printer 11, made of elastic material, in this case a plastic.

The recess 23 includes a flared mouth 24 extended by a channel 25 of width slightly less than the diameter of the fixing end 8, 9 in question, terminating in a bearing 26 proper, of circular general shape.

Two slots 27 and 28, extending on either side of the mouth 24 of the channel 25 and of the bearing 26, together form two elastic tongues 29 and 30 enabling the channel 25 to open up when the end 8, 9 is passed into it, insofar as a sufficient radial force is applied to this end 8, 9. This force is greater than the force for extracting the spindles 4, 6 from the shoe 1, so that the user, having pressed the shoe 1 onto the printer 11 and thus having inserted the fixing ends 8, 9 into their respective bearings 22, these ends remain fixed therein upon withdrawing the shoe 1.

In order to tension the ribbon 10 after loading into the printer 11, provision is made to rotate the two rolls 5, 6 herein upon withdrawing the shoe 1. In order to do this, as illustrated in FIGS. 2 and 4, one edge of the housings is extended by a projecting rubbing tongue 32, 42.

Figure 4:
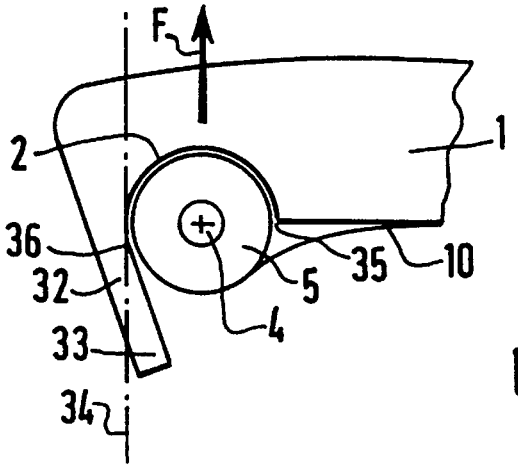
FIG. 4 is a detail of the shoe of FIG. 2.

Referring to FIG. 4, the tongue 32 is arranged so as, when loading, to remain in contact with the roll 5 at the start of the withdrawal of the shoe 1, in the direction of the arrow F, and thus to create a rubbing torque which rotates the roll 5 in the winding direction of the ribbon 10.

The housing 2 holds the roll 5 until it is gripped between the edge 35 and a contact area 36 located close to the base of the tongue 32, the area 36 extending in the detachment plane 34 of the roll 5, parallel to the arrow F, and the tongue 32 being pushed back on the other side of the plane 34.

As a result, when detaching the shoe 1, contact is maintained between the rubbing wall 33 of the tongue 32 and the roll 5, thereby rotating it, the tongue 32 being pushed back progressively outward.

The shoe of the invention, ready to use, is arranged in a packaging box; it may also be put into a capsule or bag.

Being advantageously made of an inexpensive material, it is disposable.

We claim:

1. A loading shoe adapted for operatively loading a ribbon pay-out roll and a ribbon take-up roll, of a thermal transfer printing ribbon, into a thermal transfer printer; said loading shoe comprising means for receiving and detachably holding the ribbon pay-out roll and the ribbon take-up roll in their relative use positions in said printer, wherein each of the ribbon pay-out roll and the ribbon take-up roll comprises means for fixing thereof respectively to said printer and wherein the shoe is configured to leave said respective fixing means exposed to permit fixing of the ribbon pay-out roll and ribbon take-up roll to said printer, with said shoe being adapted to be removed from the ribbon pay-out roll and take-up roll after said fixing.

2. Loading shoe according to claim 1, including a housing (2, 3) in which at least one of the rolls (5, 6) of ribbon is received in the housing (2, 3) in the shoe (1), said housing including means to tension the ribbon, said means including at least one rubbing edge (33) arranged to interact with the at least one of the rolls (5, 6) respectively when the at least one of the rolls (5, 6) is detached from the shoe (1) and thus to tension the ribbon (10).

3. Loading shoe according to claim 2, in which the housing (2) with the at least one rubbing edge (33) comprising a contact area (36) for contact with one of the rolls and with a rubbing tongue (32) having an inner wall (33) pushed back, beyond the contact area (36) of the housing (2) and the at least one of the rolls (5, 6) in a detachment plane (34) of the at least one of the rolls (5, 6), on the other side of the plane (34).

4. Loading shoe according to claim 1, wherein said shoe comprises means for tensioning the ribbon on the rolls, when the shoe is removed from the rolls.

* * * * *